US007261452B2

(12) United States Patent
Coushaine et al.

(10) Patent No.: US 7,261,452 B2
(45) Date of Patent: Aug. 28, 2007

(54) LED HEADLIGHT

(75) Inventors: Charles M. Coushaine, Rindge, NH (US); Thomas Tessnow, Weare, NH (US)

(73) Assignee: Osram Sylvania Inc., Danvers, MA (US)

( * ) Notice: Subject to any disclaimer, the term of this patent is extended or adjusted under 35 U.S.C. 154(b) by 290 days.

(21) Appl. No.: 11/053,107

(22) Filed: Feb. 8, 2005

(65) Prior Publication Data

US 2006/0061286 A1 Mar. 23, 2006

Related U.S. Application Data

(60) Provisional application No. 60/612,080, filed on Sep. 22, 2004.

(51) Int. Cl.
*F21S 8/10* (2006.01)

(52) U.S. Cl. ..... 362/545; 362/507

(58) Field of Classification Search ..... 362/555, 362/545, 507

See application file for complete search history.

(56) References Cited

U.S. PATENT DOCUMENTS

| | | | | |
|---|---|---|---|---|
| 4,037,096 A * | 7/1977 | Brendgord et al. | ..... | 362/294 |
| 6,443,582 B1 * | 9/2002 | Tarne et al. | ..... | 362/27 |
| 6,533,429 B2 * | 3/2003 | Yoneda | ..... | 362/600 |
| 6,848,819 B1 * | 2/2005 | Arndt et al. | ..... | 362/545 |
| 2003/0091279 A1 | 5/2003 | Dho | | |

FOREIGN PATENT DOCUMENTS

| | | |
|---|---|---|
| DE | 32 37 119 | 4/1984 |
| DE | 101 39 578 | 4/2003 |
| EP | 1 184 619 | 3/2002 |
| GB | 2127949 A * | 4/1984 |
| WO | WO 02/97325 | 12/2002 |

* cited by examiner

*Primary Examiner*—Hargobind S. Sawhney
(74) *Attorney, Agent, or Firm*—William E. Meyer

(57) ABSTRACT

A lamp (10) has a housing (12) with a base (14) with an internal circumferential wall (16) arranged about a longitudinal axis (18). A hollow body (20) projects from the housing (12) and is symmetrically arrayed about the longitudinal axis (18). A light guide (21) is positioned in the hollow body (20) and as a single output end (22) arrayed along the longitudinal axis (18) and has a plurality of radially extending arms (23), each of the arms having an input end (24). The light guide (21) is preferably constructed from a molded acrylic or a suitable glass having wave-guide characteristics.

2 Claims, 3 Drawing Sheets

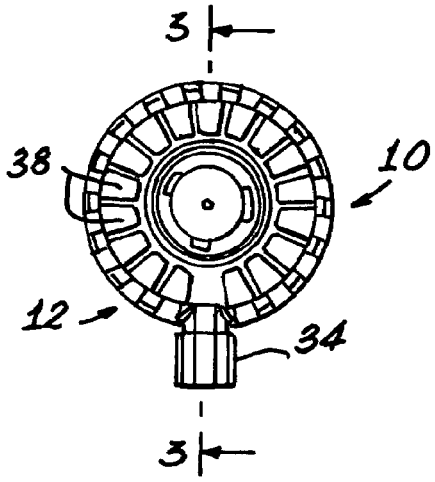
Fig. 2
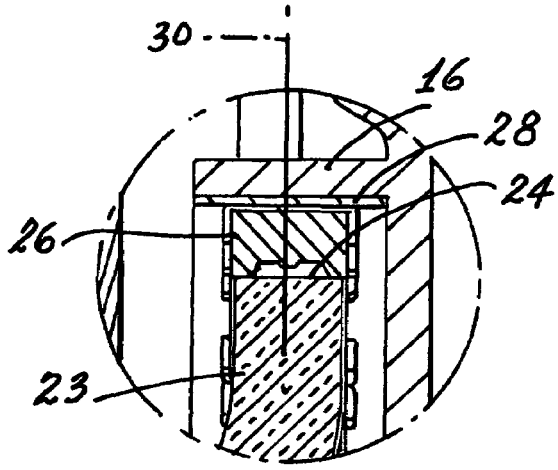
Fig. 4
Fig. 1
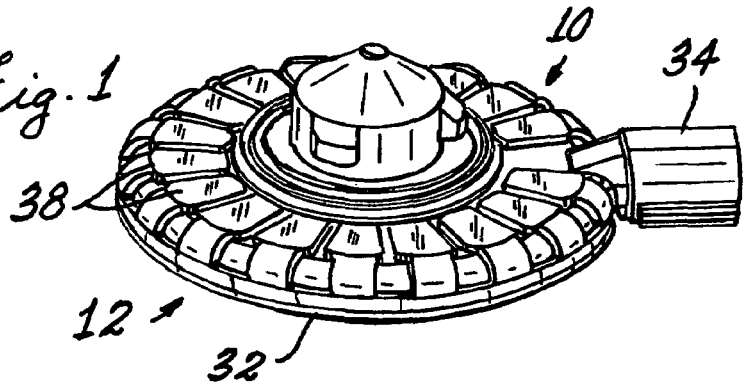
Fig. 3
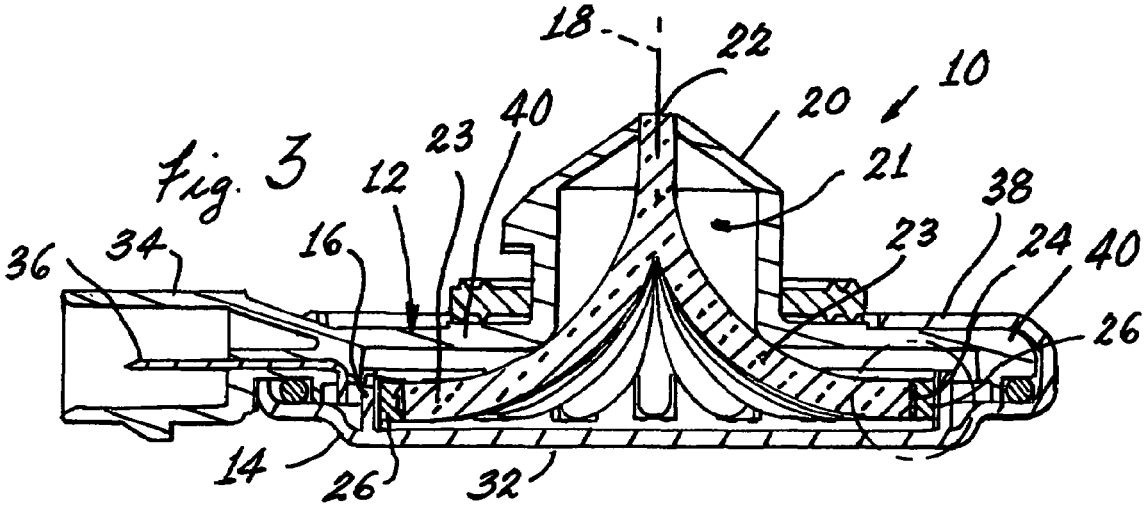

LED HEADLIGHT

CROSS-REFERENCE TO RELATED APPLICATIONS

This application claims priority from Provisional Patent Application No. 60/612,080, filed Sep. 22, 2004.

TECHNICAL FIELD

This invention relates to automotive headlights and more particularly to such headlights employing light emitting diodes (hereafter, LED or LEDs). Still more particularly it relates to a headlight using multiple LEDs but emulating a point source, allowing the light source to be used with, for example, a projector lens.

BACKGROUND ART

The long-life and appreciable ruggedness of LED light sources has produced a desire to use such light sources in automotive applications. Currently, these applications have been limited to stop lights and taillights and internal illumination. Recently developed LEDs capable of emitting white light have suggested that they might also be used for headlights. For example, U.S. Pat. No. 6,406,172 teaches the employment of multiple red, green and blue emitting LEDs arranged in a matrix, whose light is blended to emit a version of white light. The light output can also be varied by computer control and can accommodate directional variation by the vehicle with which they are used.

Newer versions of white light emitting LEDs employ blue and ultra violet-emitting LED sources in combination with a yellow light emitting phosphor, which blends the output into a white light While the matrix versions of LED combinations provide different opportunities for forward lighting, it would be an advance in the art to provide light emitting diodes light source the replicated a point source.

DISCLOSURE OF INVENTION

It is, therefore, an object of the invention to obviate the disadvantages of the prior art.

It is another object of the invention to enhance forward lighting of automotive vehicles.

Still another object of the invention is the provision of an LED lamp utilizing multiple LEDs that emulates a point source.

These objects are accomplished, in one aspect of the invention, by a lamp that comprises a housing having a base with a circumferential wall arranged about a longitudinal axis; a hollow body projecting from the base symmetrically arrayed about the longitudinal axis; a light guide having a single output end arrayed along the longitudinal axis and having a plurality of radially extending arms, each of the arms having an input end; and a like plurality of light emitting diodes operatively positioned with respect to the radially extending arms. In a preferred embodiment of the invention the light emitting diodes are arrayed about the circumferential wall.

BRIEF DESCRIPTION OF THE DRAWINGS

FIG. 1 is a perspective view of an embodiment of a lamp of the invention;

FIG. 2 is a plan view of the lamp of FIG. 1;

FIG. 3 is a sectional view taken along the line 3-3 of FIG. 2;

FIG. 4 is an enlarged view of the jointure between an LED and optical light guide;

BEST MODE FOR CARRYING OUT THE INVENTION

Figure 6:
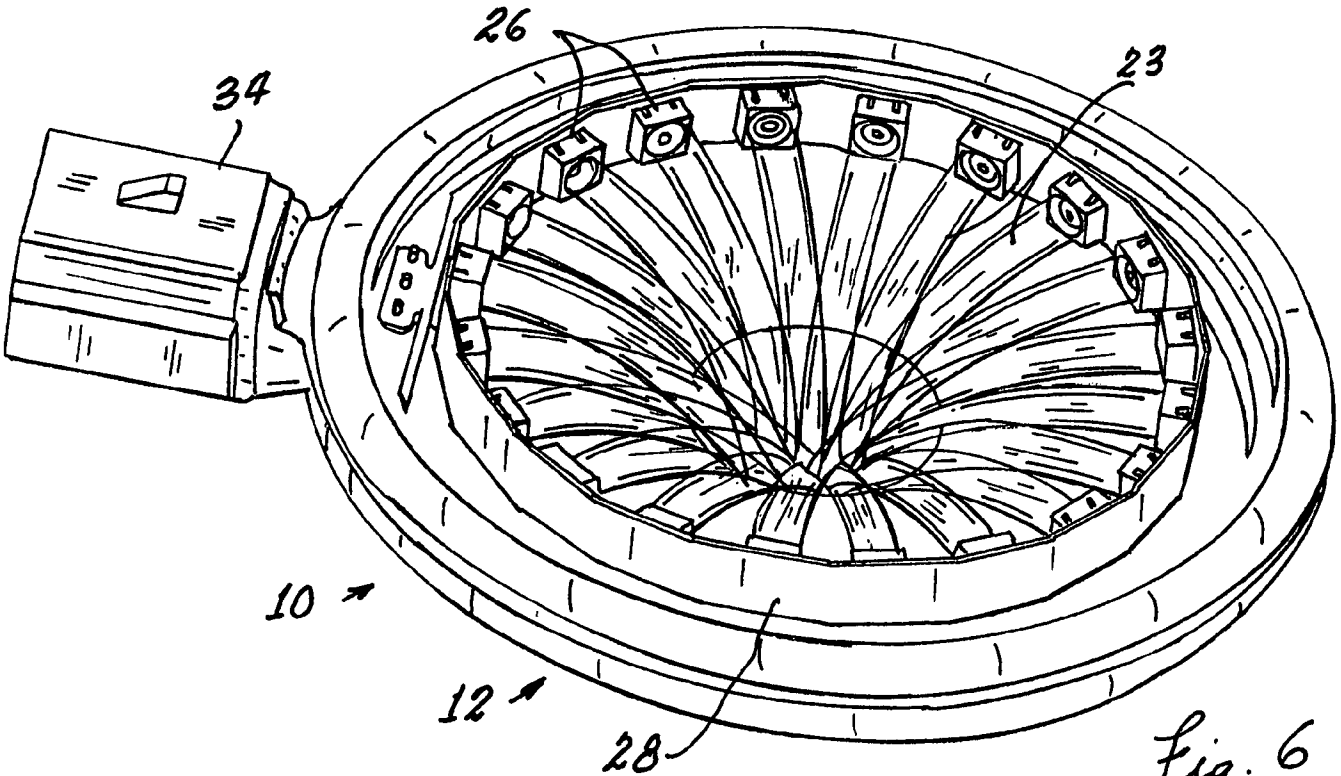
FIG. 6 is a perspective view of a wave-guide inserted into a lamp body.
Figure 5:
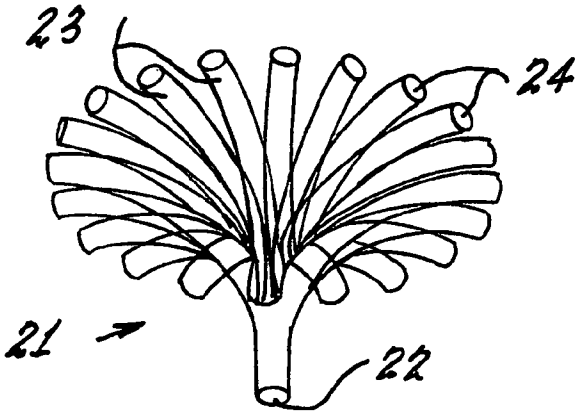
FIG. 5 is a perspective view of a light guide.
Figure 8:
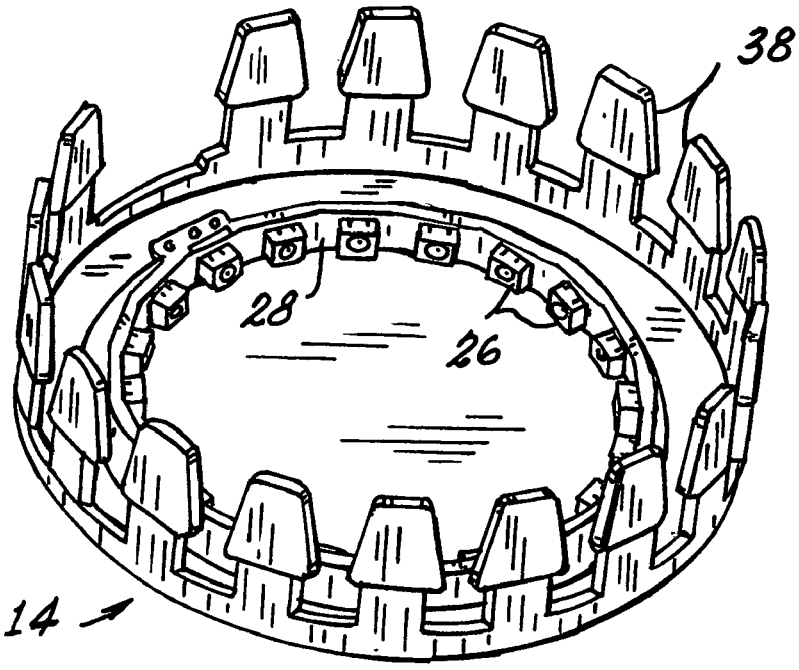
FIG. 8 is a perspective view of the LED-bearing printed circuit board positioned in the base of the lamp.
Figure 7:
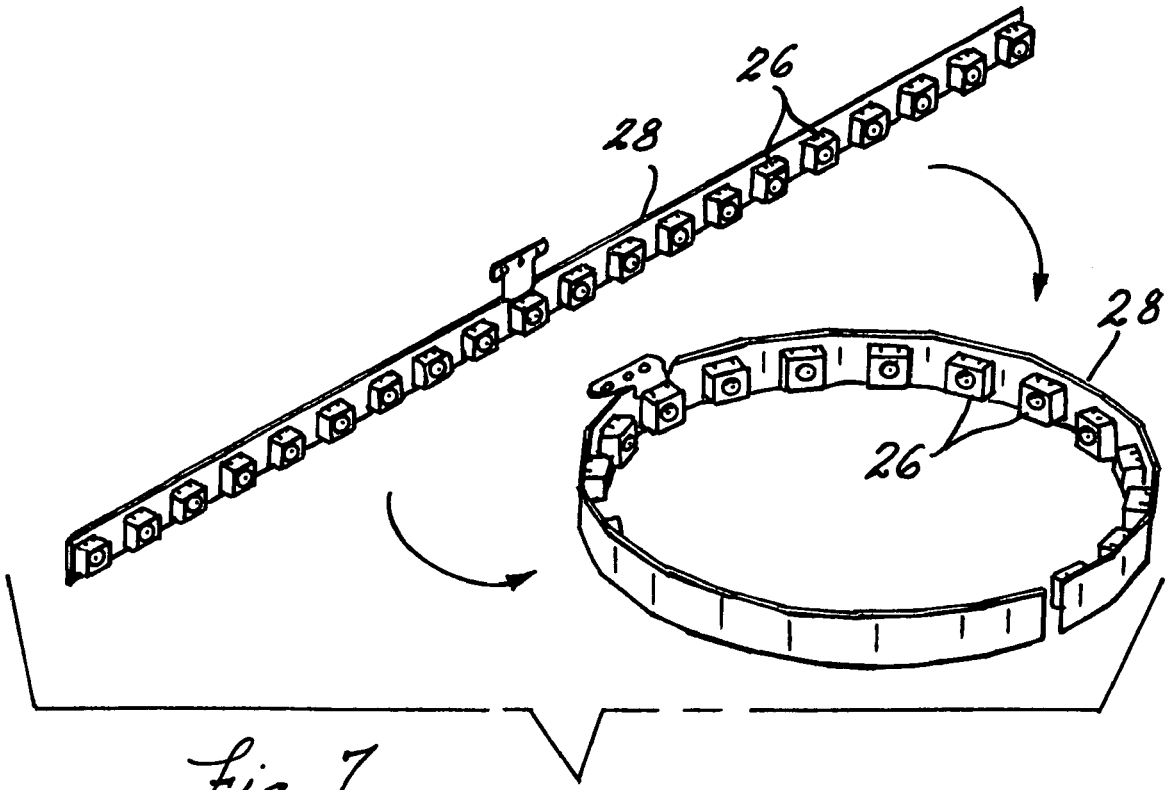
FIG. 7 is an exploded perspective view of LEDs fixed to a flexible printed circuit board.

For a better understanding of the present invention, together with other and further objects, advantages and capabilities thereof, reference is made to the following disclosure and appended claims taken in conjunction with the above-described drawings.

Referring now to the drawings with greater particularity, there is shown in FIG. 1 a lamp 10 comprising a housing 12 having a base 14 with an internal circumferential wall 16 arranged about a longitudinal axis 18. A hollow body 20 projects from the housing 12 and is symmetrically arrayed about the longitudinal axis 18. A light guide 21 is positioned in the hollow body 20 and has a single output end 22 arrayed along the longitudinal axis 18 and has a plurality of radially extending arms 23, each of the arms having an input end 24. The light guide is preferably constructed from a molded acrylic or a suitable glass having wave-guide characteristics.

In a preferred embodiment, a like plurality of light emitting diodes 26 is operatively positioned with respect to the radially extending arms 23 such that each light emitting diode 26 emits its light along an axis of emission 30 that is substantially normal to the longitudinal axis 18 and directly into the respective input end 24 of one of the respective or associated arms 23. As used herein the word "directly" does not exclude an intermediate binding material or a light gathering lens.

In a preferred embodiment of the invention the light emitting diodes 26 are affixed to a flexible printed circuit board 28 that is attached to the circumferential wall 16, as can best be seen in the expanded view of FIG. 4. The LEDs 26 can also be mounted on a ring surrounding the ends of arms 23. The ring could then be slipped into the housing and the optical guide inserted to mate pair-wise each LED with a corresponding input end of a light guide arm.

The lamp 10 further includes a heat sink 32 that is thermally coupled to the light emitting diodes 26. The heat sink 32 can be a part of the base 14 or it can be an additional element attached thereto.

The housing 10 includes an electrical socket 34 containing electrical contacts for distributing power to the light emitting diodes via connections on the printed circuit board 28.

In an embodiment of the invention the base 14 is provided with a plurality of fingers 38 that are formed to overlie a flange 40 extending from the hollow body 20 and forming a part of the housing 12. Such a feature is shown in co-pending patent application Ser. No. 10/838,090, filed May 3, 2004 and assigned to the assignee of the instant invention.

Thus, there is provided a light emitting diode lamp using multiple light emitting diodes whose collective light output is concentrated into a single point, from whence the light output can be further concentrated and directed by a suitable lens for use as forward lighting for an automotive head lamp.

The axial measurement of the lamp is then shortened, and the LEDs are well dispersed one from the other for improved heat dissipation. The support ring for the LED's is easily pre-made and quickly mated to the optical spider.

While there have been shown and described what are present considered to be the preferred embodiments of the invention, it will be apparent to those skilled in the art that various changes and modifications can be made herein without departing from the scope of the invention as defined by the appended claims.

What is claimed is:

1. An automotive headlight comprising:

a housing having a base with a circumferential wall arranged about a longitudinal axis;

a hollow body projecting from the base symmetrically arrayed about the longitudinal axis;

a light guide having a single output end arrayed along the longitudinal axis within said hollow body and having a plurality of radially extending arms projecting beyond said hollow body, each of the arms having an input end; and a like plurality of light emitting diodes operatively positioned with respect to the radially extending arms; said light emitting diodes being affixed to a flexible printed circuit board, said flexible printed circuit board being arrayed on the inside surface of said circumferential wall, whereby collective light output from said light emitting diodes is concentrated into a single point, from whence the light output being concentrated and directed by a suitable lens forward from said automotive headlight.

2. The automotive headlight of claim 1 wherein light emitting diodes are arrayed about the circumferential wall.

* * * * *